US005614359A

United States Patent [19]

Eshelman et al.

[11] Patent Number: 5,614,359

[45] Date of Patent: Mar. 25, 1997

[54] HIGH SPEED EMULSIONS EXHIBITING SUPERIOR CONTRAST AND SPEED-GRANULARITY RELATIONSHIPS

[75] Inventors: Lyn M. Eshelman; David H. Levy; Paul J. Madigan, all of Rochester, N.Y.

[73] Assignee: Eastman Kodak Company, Rochester, N.Y.

[21] Appl. No.: 592,798

[22] Filed: Jan. 26, 1996

[51] Int. Cl.[6] ..... G03C 1/035

[52] U.S. Cl. ..... 430/567; 430/570; 430/581

[58] Field of Search ..... 430/567, 570, 430/581

[56] References Cited

U.S. PATENT DOCUMENTS

| | | | |
|---|---|---|---|
| 4,435,501 | 3/1984 | Maskasky | 430/434 |
| 4,439,520 | 3/1984 | Kofron et al. | 430/434 |
| 4,775,617 | 10/1988 | Goda | 430/567 |
| 4,806,461 | 2/1989 | Ikeda et al. | 430/567 |
| 4,839,268 | 6/1989 | Bando | 430/567 |
| 4,914,010 | 4/1990 | Momoki | 430/399 |
| 4,977,074 | 12/1990 | Saitou et al. | 430/567 |
| 5,132,203 | 7/1992 | Bell et al. | 430/567 |
| 5,210,013 | 5/1993 | Tsaur et al. | 430/567 |
| 5,250,403 | 10/1993 | Antoniades et al. | 430/505 |
| 5,272,048 | 12/1993 | Kim et al. | 430/503 |
| 5,334,469 | 8/1994 | Sutton et al. | 430/21 |
| 5,334,495 | 8/1994 | Black et al. | 430/567 |
| 5,411,851 | 5/1995 | Maskasky | 430/569 |
| 5,418,125 | 5/1995 | Maskasky | 430/569 |
| 5,460,934 | 10/1995 | Delton | 430/567 |
| 5,470,698 | 11/1995 | Wen | 430/567 |
| 5,494,789 | 2/1996 | Daubendiek et al. | 430/567 |

OTHER PUBLICATIONS

Farnell, "The Relationship Between Speed and Grain Size", *The Journmal of Photographic Science,* vol. 17, 1969, pp. 116–125.

Tani, "Factors Influencing Photographic Sensitivity", *Journal of Photographic Science and Technology, Japan,* vol. 43, No. 6, 1980, pp. 335–346.

*Primary Examiner*—Mark F. Huff

*Attorney, Agent, or Firm*—Carl O. Thomas

[57] ABSTRACT

Spectrally sensitized tabular grain emulsions are disclosed exhibiting (1) increased speeds and (2) contrasts and speed-granularity relationships superior to those of conventional emulsions of the same average grain sizes. The tabular grains have {111} major faces, contain greater than 80 mole percent bromide, based on silver, and are substantially free of iodide, exhibit an average aspect ratio of greater than 50 and an average equivalent circular diameter of >10 micrometers, account for greater than 90 percent of total grain projected area, and have latent image forming chemical sensitization sites on their surfaces including epitaxially deposited silver halide protrusions of a face centered cubic rock salt crystal lattice structure forming epitaxial junctions with the tabular grains. The protrusions are restricted to those portions of the tabular grains (a) located nearest peripheral edges of and (b) accounting for less than 50 percent of the {111} major faces of the tabular grains. The protrusions contain silver iodide and a silver chloride concentration at least 10 mole percent higher than that of the tabular grains.

14 Claims, No Drawings

HIGH SPEED EMULSIONS EXHIBITING SUPERIOR CONTRAST AND SPEED-GRANULARITY RELATIONSHIPS

FIELD OF THE INVENTION

The invention relates to silver halide photography. More specifically, the invention relates to spectrally sensitized silver halide emulsions.

DEFINITION OF TERMS

In referring to silver halide grains or emulsions containing two or more halides, the halides are named in order of ascending concentrations.

The term "high bromide" in referring to silver halide grains and emulsions is employed to indicate at least 80 mole percent bromide, based on total silver forming the grains or emulsions.

The "equivalent circular diameter" (ECD) of a grain is the diameter of a circle having an area equal to projected area of the grain.

The "aspect ratio" of a silver halide grain is the ratio of its ECD divided by its thickness (t).

The term "tabular grain" is defined as a grain having two parallel major faces that are each significantly larger than an other single crystal face.

The term "tabular grain emulsion" is defined as an emulsion in which at least 50 percent of total grain projected area is accounted for by tabular grains.

The terms "thin" and "ultrathin" in referring to tabular grains and tabular grain emulsions indicates a mean tabular grain thickness of less than 0.2 and 0.07 μm, respectively.

The term "{111} tabular" in referring to tabular grains and emulsions is employed to indicate that the tabular grains have major faces that lie in {111} crystal lattice planes.

The term "coefficient of variation" (COV) is defined as 100 times the standard deviation of grain ECD divided by mean grain ECD.

The term "epitaxy" is employed in its art recognized usage to indicate a crystalline form having its orientation controlled by that of another crystalline form serving as a substrate for its deposition.

*Research Disclosure* is published by Kenneth Mason Publications, Ltd., Dudley House, 12 North St., Emsworth, Hampshire P010 7DQ, England.

BACKGROUND

Kofron et al U.S. Pat. No. 4,439,520 ushered in the current era of high speed, high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed. The most highly controlled site depositions (e.g., corner specific epitaxy siting) and the highest photographic speeds reported by Maskasky I were obtained by epitaxially depositing silver chloride onto silver iodobromide tabular grains. Maskasky I taught a preference for epitaxially depositing a silver salt having a higher solubility than the host tabular grains, stating that this reduces any tendency toward dissolution of the tabular grains while silver salt is being deposited. Maskasky I recognized that even when chloride is the sole halide run into a tabular grain emulsion during epitaxial deposition, a minor portion of the halide contained in the host tabular grains can migrate to the silver chloride epitaxy. However, the concentration in the epitaxy of any halide derived solely from the host tabular grain cannot be higher in the epitaxy than it is in the adjacent portion of the host tabular grain.

While Kofron et al and Maskasky I both acknowledged the possibility of very large average tabular grain sizes, ranging up to 10, 20 or even 30 micrometers (μm), in fact, upon extensive further investigation, the art has adopted 10 μm as an upper limit for the mean ECD's of tabular grain emulsions, and 5 μm has emerged as a preferred maximum mean ECD, as illustrated by the teachings of Goda U.S. Pat. No. 4,775,617, Ikeda et al U.S. Pat. No. 4,806,461, Bando U.S. Pat. No. 4,839,268, Momoki U.S. Pat. No. 4,914,010, Saitou et al U.S. Pat. No. 4,977,074, Bell et al U.S. Pat. No. 5,132,203, Tsaur et al U.S. Pat. No. 5,210,013, Antoniades et al U.S. Pat. No. 5,250,403, Kim et al U.S. Pat. No. 5,272,048, Sutton et al 5,334,469, Black et al U.S. Pat. No. 5,334,495, Maskasky U.S. Pat. Nos. 5411,851 and 5,418,125, Delton U.S. Pat. No. 5,460,934, and Wen U.S. Pat. No. 5,470,698. With a high level of consistency patent Examples of tabular grain emulsions show mean ECD's well below 5 μm.

The reason the art abandoned interest in tabular grain emulsions having mean ECD's above 10 μm and has established 5 μm as a preferred upper limit of tabular grain mean ECD's is that as mean ECD's are increased above 5 μm higher granularities are observed, but no further increases in speed are observed. Thus, tabular grain emulsions are subject to the same losses in imaging efficiency with increasing grain sizes that have long been known to photographic scientists—that is, while speed and granularity increase in a predictable relationship up to a maximum speed, further increases in grain size merely increase granularity without increasing photographic speed. Reports of these observations are illustrated by Farnell, "The Relationship Between Speed and Grain Size", *The Journal of Photographic Science*, Vol. 17, 1969, pp. 116–125, and Tani, "Factors Influencing Photographic Sensitivity", *Journal of Photographic Science and Technology, Japan*, Vol. 43, No. 6, 1980, note particularly FIG. 1.

When working with emulsions differing in mean ECD below the mean ECD that produces maximum speed, the "predictable relationship" referred to above is this: If each stop (0.3 log E, where E is exposure in lux-seconds) increase in speed is accompanied by a granularity increase of 7 grain units, the emulsions in a series being compared are considered to exhibit equal photographic efficiency. For example, assigning a relative log speed of 100 to a reference emulsion, when an emulsion of a higher mean ECD exhibits a relative log speed of 130 (each unit difference in log speed=0.01 log E) and exhibits a granularity that is increased by 7 grain units, the two emulsions are exhibiting the relationship in performance that the art has established to exist between emulsions of the same photographic efficiency.

From the definition of COV above it is apparent that the standard deviation of grain size increases as the mean ECD of an emulsion increases. This in turn translates into lower levels of contrast, absent other adjustments. Thus, an additional disadvantage encountered in attempting to prepare progressively higher ECD tabular grain emulsions is that contrast declines as the mean ECD increases, even when COV remains constant. Thus, even if the speed barrier noted above could be overcome, the reduction in contrast would also restrict the range of photographic applications that can be served by higher tabular grain emulsions.

RELATED PATENT APPLICATIONS

Deaton et al U.S. Ser. No. 08/451,881, filed May 26, 1995 (as a continuation-in-part of U.S. Ser. No. 08/297,145, filed Aug. 26, 1994), allowed and commonly assigned, titled ULTRATHIN TABULAR GRAIN EMULSIONS WITH SENSITIZATION ENHANCEMENTS (II), discloses a radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of from 0.7 to 10 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the tabular grains contain less than 10 mole percent iodide and the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including a higher iodide concentration than those portions of the tabular grains extending between the {111} major faces and forming epitaxial junctions with the protrusions.

Eshelman et al U.S. Ser. No. 08/592,798, concurrently filed and commonly assigned, titled HIGH SPEED EMULSIONS EXHIBITING SUPERIOR SPEED-GRANULARITY RELATIONSHIPS, discloses spectrally sensitized tabular grain emulsions exhibiting increased speeds and speed-granularity relationships superior to those of conventional emulsions of the same average grain sizes. The tabular grains have {111} major faces, contain greater than 70 mole percent bromide and from 0.25 to 10 mole percent iodide, based on silver, exhibit an average aspect ratio of greater than 50 and an average equivalent circular diameter of >10 micrometers, account for greater than 90 percent of total grain projected area, and have latent image forming chemical sensitization sites on their surfaces including epitaxially deposited silver halide protrusions of a face centered cubic rock salt crystal lattice structure forming epitaxial junctions with the tabular grains. The protrusions are restricted to those portions of the tabular grains (a) located nearest peripheral edges of and (b) accounting for less than 50 percent of the {111} major faces of the tabular grains, contain a silver chloride concentration at least 10 mole percent higher than that of the tabular grains, and include a higher iodide concentration than those portions of the tabular grains extending between the {111} major faces and forming epitaxial junctions with the protrusions.

SUMMARY OF THE INVENTION

The invention relates to radiation-sensitive high bromide silver halide emulsions that exhibit higher photographic speeds than have heretofore been realized in the art. Whereas, prior to this invention the art has been unable to increase the speed of tabular grain emulsions by increasing mean grain sizes beyond 5 μm, the present invention has eliminated the tabular grain size barrier to higher photographic imaging efficiencies and speeds. This has been accomplished by the discovery that substantially iodide-free high bromide tabular grains exhibiting a mean grain ECD of greater than 10 μm can be sensitized to exhibit higher speeds than (1) otherwise similar smaller mean ECD emulsions and (2) emulsions containing the same tabular grain population, but conventionally sensitized (e.g., sulfur and gold sensitized). The emulsions of the invention exhibit improved speed-granularity relationships and increased contrast as compared to previously disclosed emulsions of the same mean ECD's.

In one aspect, this invention is directed to a radiation-sensitive emulsion comprised of (1) a dispersing medium, (2) silver halide grains including tabular grains (a) having {111} major faces, (b) substantially free of iodide containing at least 80 mole percent bromide, based on silver, (c) accounting for greater than 90 percent of total grain projected area, and (d) having latent image forming chemical sensitization sites on the surfaces of the tabular grains, and (3) a spectral sensitizing dye adsorbed to the surfaces of the tabular grains, wherein (4) the surface chemical sensitization sites include epitaxially deposited silver halide protrusions of a face centered cubic rock salt crystal lattice structure forming epitaxial junctions with the tabular grains, the protrusions (a) being restricted to those portions of the tabular grains located nearest peripheral edges of and accounting for less than 50 percent of the {111} major faces of the tabular grains and (b) containing silver iodide and a silver chloride concentration at least 10 mole percent higher than that of the tabular grains, and (5) the tabular grains exhibit an average aspect ratio of greater than 50 and an average equivalent circular diameter of greater than 10 micrometers.

DESCRIPTION OF PREFERRED EMBODIMENTS

The invention is directed to an improvement in spectrally sensitized photographic emulsions. The invention provides for use in black-and-white (including indirect X-ray) and color photography emulsions having higher speeds than have heretofore been realized. Further, these large increases in speed have been accomplished with lower levels of granularity and higher levels of contrast than have heretofore been observed for emulsions of the same mean grain sizes.

The advantages of the invention are realized by the chemical and spectral sensitization of tabular grain emulsions in which the host tabular grains (a) have {111} major faces, (b) substantially free of iodide and containing at least 80 mole percent bromide, based on total silver forming the tabular grains, (c) account for greater than 90 percent of total grain projected area, (d) exhibit an average aspect ratio of greater than 50, and (e) exhibit an average equivalent circular diameter of greater than 10 micrometers.

Although these criteria are individually and in varied combinations taught in various patents, there is no conventional emulsion that combines all of these criteria. Notice that when the average aspect ratio (ECD/t) is greater than 50 and the mean ECD is just greater than 10 μm, the mean thickness of the tabular grains must be less than 0.2 μm—i.e., the tabular grain emulsions are thin tabular grain emulsions.

Host tabular grain emulsions satisfying criteria (a)–(e) can be realized by choosing thin tabular grain emulsions from among the many conventional emulsions satisfying criteria (a)–(c). Following conventional techniques of tabular grain growth with minimal increase in tabular grain thickness, these emulsions can then be further grown to satisfy criteria (d) and (e). It is preferred to extend tabular grain growth to exceed a mean ECD of 10 μm by extending a conventional precipitation known to produce tabular grain emulsions satisfying criteria (a)–(c) and to produce a tabular grain mean thickness of less than 0.1 μm. It is specifically preferred to extend the growth times of conventional ultrathin (<0.07 μm) tabular grain emulsions. The following, here incorporated by reference, illustrate preferred emulsion precipitations that, by elimination of iodide, where present, and extension of the growth step, are capable of providing host tabular grains satisfying criteria (a)–(e):

Daubendiek et al U.S. Pat. No. 4,914,014,

Tsaur et al U.S. Pat. No. 5,210,013,

Antoniades et al U.S. Pat. No. 5,250,403,

Maskasky U.S. Pat. No. 5,411,851,

Maskasky U.S. Pat. No. 5,418,125,

Delton U.S. Pat. No. 5,460,934,

Olm et al U.S. Ser. No. 08/296,562, filed Aug. 26, 1994, now allowed,

Daubendiek et al U.S. Ser. No. 08/297,430, filed Aug. 26, 1994, now allowed, and Daubendiek et al U.S. Ser. No. 08/359,251, filed Dec. 19, 1994, now allowed.

Zola et al EPO 0 362 699 A3 also discloses tabular grain emulsions that, with elimination of iodide, are useful starting emulsions for further grain growth to provide the host tabular grain population required by the invention. It is generally recognized that procedures for preparing high bromide iodide containing tabular grain emulsions can be adapted to prepare corresponding high bromide iodide-free tabular grain emulsions merely by eliminating iodide ion addition. This is taught, for example, by Kofron et al. Thus, in the citations above, where iodide is disclosed to be incorporated, it is simply omitted.

The host tabular grain emulsions are substantially free of iodide. That is, they contain less than 0.25 mole percent iodide, based on total silver forming the tabular grains. The host tabular grains are contemplated to contain only impurity levels of iodide as precipitated. Iodide has traditionally been relied upon to enhance photographic speed. In this invention it has been observed quite surprisingly that maintaining the host tabular grains substantially free of iodide as precipitated improves the speed-granularity relationship and increases the contrast of the emulsions of the invention while still achieving higher photographic speeds than have been heretofore realized.

It is possible to include minor amounts of chloride ion in the host tabular grains. As disclosed by Delton U.S. Pat. Nos. 5,372,927 and 5,460,934, here incorporated by reference, tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton. Under these conditions of precipitation the presence of chloride ion actually contributes to reducing the thickness of the tabular grains.

As fully grown the host tabular grains contain at least 80 mole percent bromide, based on total silver, with chloride being optionally present. The extended growth required to reach mean ECD's of greater than 10 μm can employ any halide composition compatible with the precipitation conditions employed. For convenience and simplicity the same halide ratios as in the preceding growth are used during the extension of the growth step to reach higher mean ECD's. The host tabular grains are substantially iodide-free silver bromide and silver chlorobromide tabular grains. Chloride is preferably limited to 10 mole percent or less and most preferably to 5 mole percent or less. Optimally chloride is absent from the host tabular grains.

The host tabular grains of the emulsions of the invention account for greater than 90 percent of total grain projected area. Host tabular grain emulsions in which the tabular grains account for greater than 97 percent of total grain projected area can be produced by the preparation procedures taught by Antoniades et al and are preferred. Antoniades et al reports emulsions in which >99% (substantially all) of total grain projected area is accounted for by tabular grains. Similarly, Delton reports that substantially all of the grains precipitated in forming the tabular grain emulsions are tabular. Providing emulsions in which the tabular grains account for a high percentage of total grain projected area is important to achieving the highest attainable image sharpness levels, particularly in multilayer color photographic films. It is also preferred for utilizing silver efficiently and achieving the most favorable speed-granularity relationships.

In the preferred host tabular grain emulsions grain to grain variances are held to a minimum. Antoniades et al reports tabular grain emulsions in which greater than 90 percent of the tabular grains have hexagonal faces. Antoniades et al also reports tabular grain emulsions exhibiting a COV based on ECD of less than 25 percent and even less than 20 percent.

The mean ECD's of the host tabular grain emulsions can range up to 20 or even 30 μm, as taught by Maskasky I. However, to realize increased speeds with minimal increases in granularity, it is preferred to limit the mean ECD's of the host tabular grain emulsion to 15 μm or less.

It has been discovered quite unexpectedly that the maximum speed limit observed for conventional tabular grain emulsions having mean ECD's of 5 μm and higher can be exceeded when silver halide epitaxy of a selected composition is deposited at selected sites onto the >10 μm mean ECD host tabular grain emulsions described above.

The chemical and spectral sensitizations of this invention improve upon the best chemical and spectral sensitizations disclosed by Maskasky I. In the practice of the present invention host tabular grains receive during chemical sensitization epitaxially deposited silver halide forming protrusions at selected sites on the host tabular grain surfaces. Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host tabular grains. It would be more precise to reference the higher chloride concentration in the silver halide protrusions to the chloride ion concentration in the epitaxial junction forming portions of the host tabular grains, but this is not necessary, since the chloride ion concentrations of the host tabular grains are contemplated to be substantially uniform (i.e., to be at an average level) or to decline slightly due to halide displacement in the epitaxial junction regions.

Contrary to the teachings of Maskasky I, it has been found that improvements in photographic performance can be realized by adding iodide ions along with silver and chloride ions while performing epitaxial deposition. Specifically, it has been observed that by limiting iodide in the host tabular grains as described above and incorporating in the epitaxially deposited protrusions an iodide concentration of at least 1 mole percent, based on the silver forming the epitaxy, it is possible to achieve higher speeds and improved speed-granularity relationships and higher contrasts, as previously described. Since the percentage of silver accounted for by the epitaxy can be quite low in comparison to total silver, the overall iodide levels in the emulsion can be quite low, which allows higher rates of development. Lowering the iodide level in the host tabular grains also results in reducing their thicknesses when otherwise comparable precipitation procedures are employed. Since the epitaxially deposited protrusions contain less silver than the host tabular grains, their iodide concentration can be increased with smaller amounts of iodide than is required to raise the iodide concentration of the host tabular grains to the same level. This is in itself an advantage in allowing higher local iodide concentrations to be realized with lower overall levels of iodide.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603 (hereinafter referred to as Maskasky II and III, respectively). Precipitation at ambient pressure, which is universally practiced in the art, limits iodide inclusion in a silver chloride crystal lattice to less than 13 mole percent. For example, introducing silver along with an 84:16 chloride:iodide molar ratio during silver halide epitaxial deposition resulted in an iodide concentration in the resulting epitaxial protrusions of less than 2 mole percent, based on silver in the protrusions. By displacing a portion of the chloride with bromide much higher levels of iodide can be introduced into the protrusions. For example, introducing silver along with a 42:42:16 chloride:bromide:iodide molar ratio during silver halide epitaxial deposited resulted in an iodide concentration in the resulting epitaxial protrusions of 7.1 mole percent, based on silver in the protrusions. Preferred iodide ion concentrations in the protrusions are in the range of from 1 to 15 mole percent (most preferably 2 to 10 mole percent), based on silver in the protrusions.

It has been discovered quite unexpectedly that further increases in speed and improvements in speed-granularity relationships at mean ECD's >10 μm can be realized by introducing along with silver ions during epitaxial deposition chloride, bromide and iodide ions. Since silver bromide and iodobromide epitaxy on the host tabular grains produces lower levels of sensitization than concurrent introductions of silver, chloride and iodide ions during epitaxy, it was unexpected that displacement of a portion of the chloride with bromide would further increase photographic performance. Analysis indicates that the introduction of chloride and bromide ions during precipitation of the epitaxial protrusions facilitates higher iodide incorporations. This can be explained in terms of the increased crystal cell lattice dimensions imparted by the increased levels of bromide ions. It does not explain why photographic performance increased rather than declining, as would be expected when the bromide concentrations in the epitaxy and host tabular become less divergent. The deposition of silver bromide on a silver bromide host grain produces none of the sensitization effects produced by epitaxial deposition.

It is believed that the highest levels of photographic performance are realized when the silver halide epitaxy contains both (1) the large differences in chloride concentrations between the host tabular grains and the epitaxially deposited protrusions noted above and (2) elevated levels of iodide inclusion in the face centered cubic crystal lattice structure of the protrusions.

One preferred technique relevant to objective (1) is to introduce the different halide ions during precipitation of the protrusions in the order of descending solubilities of the silver halides that they form. For example, if chloride, bromide and iodide ions are all introduced during precipitation of the protrusions, it is preferred to introduce the chloride ions first, the bromide ions second and the iodide ions last. Because silver iodide is less soluble than silver bromide which is in turn less soluble than silver chloride, the sequential order of halide ion addition preferred gives the chloride ion the best possible opportunity for deposition adjacent the junction. A clear stratification of the protrusions into regions exhibiting higher and lower chloride ion concentrations can in some instances be detected, but may not be detectable in every instance in which the preferred sequential halide addition is employed, since both bromide and iodide ions have the capability of displacing chloride to some extent from already precipitated silver chloride.

Increasing iodide levels in the protrusions runs directly contrary to a prior belief in the art that iodide in epitaxially deposited protrusions should be minimized to avoid morphological instability in the host tabular grains. However, it has been observed that increased iodide concentrations in the epitaxially deposited protrusions as described above is not incompatible with maintaining the tabular configuration of the host grains, even in emulsions having mean tabular grain thicknesses of <0.1 μm.

In the practice of the invention the elevated iodide concentrations in the protrusions are those that can be accommodated in a face centered rock salt cubic crystal lattice structure—that is, the type of isomorphic crystal lattice structure formed by silver and one or both of chloride and bromide. It is, of course, possible to incorporate limited amounts (generally cited as 10 mole percent or less) of bromide and/or chloride ions into nonisomorphic β or γ phase silver iodide crystal structures; however, nonisomorphic silver halide epitaxy forms no part of this invention. The structures are too divergent to ascribe similar photographic properties, and nonisomorphic epitaxial protrusions have been demonstrated by Maskasky U.S. Pat. No. 4,471,050 (hereinafter Maskasky IV) to produce much lower levels of sensitization than isomorphic crystal structure silver halide epitaxial protrusions.

Either or both of the tabular grains and silver halide epitaxy can contain conventional dopants. A summary of conventional dopants is provided by *Research Disclosure,* Vol. 365, September 1994, Item 36544, I. Emulsion grains and their preparation, D. Grain modifying conditions and adjustments, (3), (4) and (5). The incorporation of shallow electron trapping (SET) dopants in the substrate tabular grains and/or the silver halide epitaxy, as disclosed by *Research Disclosure*, Vol. 367, Nov. 1994, Item 36736, is specifically contemplated. The teachings of Olm et al U.S. Ser. No. 08/296,562, here incorporated by reference, disclose preferred SET dopants in the epitaxy.

Subject to the composition modifications specifically described above, preferred techniques for chemical and spectral sensitization are those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area. It is contemplated, to restrict silver halide epitaxy to those portions nearest peripheral edges of and accounting for less than 50 percent of the {111} major faces of the host tabular grains and, preferably, to a much smaller percent of the {111} major faces of the host tabular grains, preferably less than 25 percent, most preferably less than 10 percent, and optimally less than 5 percent of the {111} major faces of the host tabular grains. It is preferred to restrict the silver halide epitaxy to the edges and corners of the tabular grains.

Like Maskasky I, nominal amounts of silver halide epitaxy (as low as 0.05 mole percent, based on total silver, where total silver includes that in the host and epitaxy) are effective in the practice of the invention. It is preferred that the silver halide epitaxy be limited to 50 percent or less of total silver. Generally silver halide epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver halide epitaxy that can be applied in forming the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the host tabular grains is more efficient than that overlying all or most of the major faces, still better is epitaxy that is substantially confined to the edges of the host tabular grains, with limited coverage of their major faces, and still more efficient is epitaxy that is confined at or near the corners or other discrete sites of the tabular grains. The spacing of the corners of the major faces of the host tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

Silver halide epitaxy can by itself increase photographic speeds above maximum speeds observed in conventional emulsions having mean ECD's >10 μm. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure,* Vol. 365, Sept. 1994, Item 36544, Section IV. Chemical sensitization. Kofron et al illustrates the application of these sensitizations to tabular grain emulsions. Maskasky I, Olm et al U.S. Ser. No. 08/296,562, and Daubendiek et al U.S. Ser. Nos. 08/297,430 and 08/359,251, here incorporated by reference, illustrate the application of these sensitizations to tabular grain emulsions containing silver halide epitaxy on the tabular grains.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

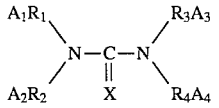

(I)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold (I) compounds disclosed by Deaton U.S. Pat. No. 5,049,485, the disclosure of which is here incorporated by reference. These compounds include those represented by the formula:

$$AuL_2^+X^- \text{ or } AuL(L^1)^{+X-} \quad \text{(II)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the host tabular grain emulsions of the invention. The selection of J-aggregating blue absorbing spectral sensitizing dyes for use as site directors is specifically contemplated. A general summary of useful spectral sensitizing dyes is provided by *Research Disclosure,* Item 36544, Section V. Spectral sensitization and desensitization, A. Sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an host tabular grain according to the invention after chemical sensitization has been completed.

The tabular grain emulsions with silver halide epitaxy once formed and sensitized can be further prepared for photographic use by any convenient conventional technique. Additional conventional features are illustrated by *Research Disclosure* Item 36544, cited above, Section II. Vehicles, vehicle extenders, vehicle-like addenda and vehicle related addenda; Section III. Emulsion washing; Section VI, UV dyes/optical brighteners/luminescent dyes; Section VII. Antifoggants and stabilizers; Section VIII. Absorbing and scattering materials; Section IX. Coating physical property modifying addenda; and Section X. Dye image formers and modifiers.

Any one of the emulsions of the invention can be coated alone onto a conventional photographic support, such as disclosed in *Research Disclosure,* Item 36544, cited above, Section XV. Supports, to form a photographic element. The emulsions of the invention can be blended with other conventional emulsions and/or coated on a photographic support along with other conventional emulsion layers. Such arrangements are illustrated by *Research Disclosure,* Item 36544, cited above, Section I. Emulsion grains and their precipitation, E. Blends, layers and performance categories. A plurality of layers containing one or more emulsions according to the invention can be incorporated into a single photographic element. Illustrations of photographic elements containing multiple emulsion layers compatible with incorporation of one or more emulsions according to the invention are found in *Research Disclosure,* Item 36544, cited above, Section XI. Layers and layer arrangements; XII. Features applicable to only color negative; XIII. Features applicable only to color reversal; and XIV. Scan facilitating features.

Photographic elements containing one or more emulsions according to the invention can be exposed by any convenient conventional technique, such as illustrated by *Research Disclosure,* Item 36544, cited above, Section XVI. Exposure. The exposed photographic elements can be conventionally processed, as illustrated by *Research Disclosure,* Item 36544, cited above, Section XVIII. Chemical development systems; Section XIX. Development; and XX. Desilvering, washing, rinsing and stabilizing.

EXAMPLES

The invention can be better appreciated by reference to the following specific embodiments.

Host Tabular Grain Emulsions

A series of similar silver iodobromide host tabular grain emulsions were precipitated, but with their mean ECD's varied.

Emulsion 4.2-IBr

A reaction vessel equipped with a stirrer was charged with 5 L of water containing 10 grams of lime-processed bone gelatin, 30 g NaBr and an antifoamant, at pH of 6.0 and 75° C. During nucleation by simultaneous 1 min. addition of 0.393M $AgNO_3$ and 2.0M NaBr added in sufficient quantity to form 0.025 mol of silver bromide, pBr and pH remained approximately at the values initially set in the reaction vessel. After nucleation and an ammonia ripening step with 0.045 mole of $NH_3$, 140 g of lime-processed bone gelatin and 15.8 g of NaBr dissolved in 1.8 L of $H_2O$ were added to the reaction vessel. Fourteen minutes after nucleation, the growth stage was begun during which 2.75M $AgNO_3$, and halide solution (2.7088M NaBr, 0.04126M KI) were added in proportions to maintain the reaction vessel pBr at the value resulting from the cited NaBr and $AgNO_3$ additions. This pBr was maintained until 8.5 moles of silver iodobromide had formed, at which time the excess $Br^-$ concentration was increased by addition of 750 mL of 2.5M NaBr. At this point, 500 mL of a 0.48M suspension of AgI Lippmann emulsion were added to the reaction vessel. The pBr was adjusted to 8.85 with 2.75M $AgNO_3$, followed by double jet growth at this pBr to complete the precipitation for a total of 12 moles of silver iodobromide. The resulting emulsion was washed by ultrafiltration, and pH and pBr were adjusted to storage values of 5.9 and 2.5, respectively.

The resulting emulsion was examined by scanning electron microscopy (SEM). Tabular grains accounted for greater than 95% of the total grain projected area, the mean ECD of the grains was 4.2 μm, and the mean tabular grain thickness was determined to be 0.14 μm.

Emulsion 2.2-IBr

This emulsion was precipitated by the same procedure as Emulsion 4.2, except the nucleation and growth temperatures were 60° C. and a 0.72M AgI Lippmann emulsion was substituted for the 0.48M AgI Lippmann emulsion.

Tabular grains accounted for greater than 95 percent of the total grain projected area. The mean ECD of the grains of this emulsion was 2.2 μm, and the mean tabular grain thickness was 0.13 μm.

Emulsion 6.5-IBr

This emulsion was prepared in the same manner as Emulsion 4.2, except oxidized bone gelatin was used and the post-nucleation ammonia level was increased to 0.09 mole. After growth to 8.5 moles of silver iodobromide as described for Emulsion 4.2, the excess $Br^-$ concentration was increased by addition of 720 mL of 3.0M NaBr. At this point, 760 mL of a 0.48M AgI Lippmann emulsion were added to the reaction vessel. The pBr was adjusted to 8.85 with 2.75M $AgNO_3$, followed by double jet growth at this pBr to complete the precipitation for a total of 12 moles of silver iodobromide. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 6.5 μm, and the mean tabular grain thickness was 0.12 μm.

Emulsion 11.5-IBr

A reaction vessel equipped with a stirrer was charged with 4 L of water containing 16 grams of lime-processed, oxidized bone gelatin and 28 g of NaBr, at pH of 5.65 and 60° C. Nucleation was accomplished by a 6 sec. addition of 0.07M $AgNO_3$ in sufficient quantity to form $9.1\times10^{-4}$ mol of silver bromide. pBr and pH remained approximately at the values initially set in the reaction vessel. During the next 12.5 minutes, a heat ramp to 75° C. and ammonia ripening with 0.036 mole of $NH_4OH$ occurred simultaneously with the addition of 0.07M $AgNO_3$ at 6.5 mL/min. The reaction temperature was lowered to 70° C., pH was adjusted to 5.7, and 100 g of lime-processed, oxidized bone gelatin and 3 g of NaBr dissolved in 4.0 L of $H_2O$ were added to the reaction vessel. Twenty minutes after nucleation, the growth stage was begun during which 1.25M $AgNO_3$, 1.25M NaBr and 0.0477M AgI Lippmann emulsion were added in proportions to maintain a uniform iodide level of 3.0 M % in during grain growth and the reaction vessel pBr at the value resulting from the cited halide and $AgNO_3$ additions. This pBr was maintained until 3.76 moles of silver iodobromide were precipitated. At this point no additional AgI was added to the reaction vessel, but growth continued at the same rate using 1.25M $AgNO_3$ and NaBr solutions to form 0.2 mole AgBr bromide shell. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 11.5 μm, and the mean tabular grain thickness was 0.13 μm.

Emulsion 10.8-IBr

This emulsion was prepared in the same manner as Emulsion 11.5, except that after the precipitation of 3.76 moles of silver iodobromide, 0.44 mole of AgI Lippmann emulsion was added and growth continued at the same rate by single jet addition of $AgNO_3$ to adjust the pBr to 9.5. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 10.8 μm, and the mean tabular grain thickness was 0.13 μm. The mean ECD of the grains of this emulsion was 10.8 μm, and the mean tabular grain thickness was 0.13 μm.

Emulsion 11.8-Br

This emulsion was prepared in the same manner as Emulsion 11.5, except no iodide was introduced during precipitation.

Tabular grains accounted for greater than 95 percent of the total grain projected area. The mean ECD of the grains of this emulsion was 11.8 μm, and the mean tabular grain thickness was 0.09 μm.

Sensitizations

The host emulsions were each either sensitized by (1) the corner epitaxial deposition of silver and a 42:42:16 molar ratio of Ci:Br:I, followed by sulfur and gold sensitization, hereafter referred to as EPI-MX or (2) sulfur and gold sensitized without epitaxial deposition, hereafter referred to as S+Au.

EPI-MX Procedure

A sample of the emulsion was melted at 40° C. and its pBr was adjusted to ≈4 with simultaneous addition of $AgNO_3$ and KI solutions in a ratio such that the small amount of silver halide precipitated during this adjustment was 12% I. On a basis of one mole of host emulsion, a solution containing 3.53 mmol KI and 14.1 mmol NaCl were added, followed by addition of the spectral sensitizing dyes DYE-1 and DYE-2. A solution containing 17.8 mmol NaCl, 17.8 mmol NaBr, 7.1 μmol $K_4Ru(CN)_6$, and 6.8 mmol of an AgI Lippmann emulsion is added. Epitaxy (42:42:16 Ci:Br:I molar ratio) in the amount of 4.24 M %, based on total silver, was completed by a 1 minute addition of 3.56 mole-% of 0.5M $AgNO_3$ solution. This procedure produced epitaxial protrusions mainly on the corners of the host tabular grains.

The epitaxially modified emulsion was split into smaller portions in order to determine optimal levels of subsequently added sensitizing components. The post-epitaxy components included additional portions of DYE-1 and DYE-2, 60 mg NaSCN/mole Ag, 1,3-dicarboxymethyl-1,3-dimethyl-2-thiourea disodium salt monohydrate (DCT), Bis(1,4,5-Trimethyl-1,2,4-Triazolium-3-Thiolate) Gold(I) Tetrafluoroborate (Au-I), and 11.4 mg 1-(3-acetamidophenyl)-5-mercaptotetrazole (APMT)/mole Ag. After all components were added, the mixture was heated to 50° C. to complete the sensitization, and, after cool-down, 114.4 mg of additional APMT/mole Ag were added.

S+Au Procedure

Small portions of emulsion were used to determine optimal levels of sensitizing components. These included 100 mg NaSCN/mole Ag, DYE-1 and DYE-2, $Na_2S_2O_3.5H_2O$ (sulfur), Au(I), and antifoggant AF-1. After all components were added, the mixture was heated to 60°–65° C. to complete the sensitization.

| | |
|---|---|
| DYE-1 | Anhydro-5-chloro-9-ethyl-5'-phenyl-3'-(3-sulfobutyl)-3-(3-sulfopropyl)oxacarbocyanine hydroxide, sodium salt |
| DYE-2 | Anhydro-6,6'-dichloro-1,1'-diethyl-3,3'-bis-(3-sulfopropyl)-5,5'-bis(trifluoromethyl)-benzimidazole carbocyanine hydroxide, sodium salt |
| AF-1 | 3-(2-Methylsulfamoylethyl)benzothiazolium tetrafluoroborate |

Sensitometry

The resulting sensitized emulsions were coated on a photographic film support in a format containing 1.3 g Ag/m$^2$, 1.1 g/m$^2$ COUP-1 and 3.2 g/m$^2$ gelatin. The emulsion layer was overcoated with a 3.2 g/m$^2$ gelatin layer containing the hardening agent bis(vinylsulfonylmethyl-)ether at a concentration of 1.8 wt. %, based on the total weight of gelatin.

COUP-1

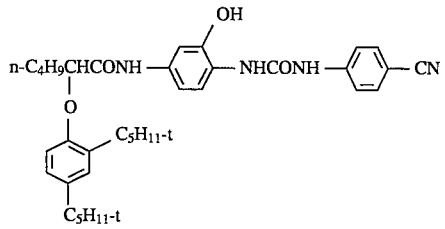

The coated emulsions were given 0.01 second Wratten 9™ filtered daylight balanced light exposures through a calibrated neutral step tablet, and then were developed to a minimum density of 0.15 using the color negative Kodak Flexicolor C41™ process.

Speed was measured at a toe density $D_s$, where $D_s$ minus $D_{min}$ equals 20 percent of the slope of a line drawn between $D_s$ and a point D' on the characteristic curve offset from $D_s$ by 0.6 log E (where E is exposure in lux-seconds).

Contrast was taken as the highest measured point gamma (dD/d log E), see James *The Theory of the Photographic Process*, 4th Ed., Macmillan, New York, 1977, p. 502.

Granularity measurements were made according to the procedures described in the *SPSE Handbook of Photographic Science and Engineering*, W. Thomas, Ed., pp. 934–939. A comparison of the granularity difference between two coatings is reported in grain units (ΔGU). The granularity readings at each step were divided by the gamma at each step and plotted vs log E. In such plots, there is typically a minimum. The minimum of this gamma-normalized granularity provides what is generally regarded as a preferred comparison of coatings having differing contrast. Lower values of the minimum gamma-normalized granularity are desired, providing less grainy images. Granularity was measured in grain units (G.U.).

Comparison of Performance

Comparisons of photographic speed and granularity are set out in Table I.

TABLE I

| Emulsion (ECD, μm) | Sens. | Speed | Contrast | Δ G.U. |
|---|---|---|---|---|
| 2.2-IBr | S + Au | 100 | 1.76 | Ref. |
| 4.2-IBr | S + Au | 130 | 1.25 | +10 |
| 6.5-IBr | S + Au | 133 | 1.12 | +17 |
| 10.8-IBr | S + Au | 131 | 1.39 | +22 |
| 11.5-IBr | S + Au | 132 | | +23 |
| 11.5-IBr | EPI-MX | 155 | 0.5 | +19 |
| 11.5-IBr | EPI-MX* | 146 | 0.84 | +18 |
| 1.5-IBr | EPI-MX** | 142 | 0.95 | +17 |
| 11.8-Br | EPI-MX | 150 | 1.2 | +14 |
| 11.8-Br | S + Au | 77 | 2.0 | +19 |

*Mixed halide epitaxy reduced to 2 M %, based on total Ag
**Mixed halide epitaxy reduced to 1 M %, based on total Ag Increasing mean ECD of S+Au sensitized AgIBr host tabular grains from 2.2 to 4.2 μm doubled emulsion speed. That is, speed increased by 30 relative log speed units or 0.30 log E. In photographic terms, this was a full stop increase in speed.

However, no further significant increase in speed in the S+Au sensitized emulsions could be realized by further increasing mean grain ECD. Increases in mean ECD from 4.2 to 10.8 μm produced no significant increases in speed. Further, granularity increased by progressively to additional 12 grain units. Finally, shifting from AgIBr to AgBr S+Au sensitized host tabular grains severely reduced speed.

When the 11.5 μm mean ECD host AgIBr tabular grain emulsion was provided with the EPI-MX sensitization contemplated by the invention, a marked increase in speed (23 log speed units) was realized and granularity reduced in comparison to the same host emulsion provided with the S+Au sensitization. When the total amount of silver in the epitaxy was decreased, speed was reduced slightly as well as granularity. However, the contrast of each of EPI-MX sensitized AgIBr tabular grain emulsions was markedly reduced as compared to the S+Au sensitized tabular AgIBr grain emulsions.

When the 11.8 μm mean ECD AgBr tabular grain emulsion was EPI-MX sensitized, it exhibited speed only slightly less (0.05 log E) than that of the 11.5-IBr EPI-MX sensitized emulsion. However, surprisingly, applying the conversion 7 grain units=0.30 log E, the speed-granularity relationship as well as the contrast of 11.8-Br EPI-MX was superior to that of the 11.5-IBr EPI-MX emulsion.

The advantageous performance of the emulsions of the invention was quite surprising. When the quite low speed levels of S+Au sensitized silver bromide tabular grain emulsions having mean ECD's of >10 μm is taken into account, it could not have been predicted that changing to the EPI-MX sensitization would produce higher speeds than have heretofore been obtained in S+Au sensitized silver iodobromide tabular grain emulsions. It was particularly surprising that a >10 μm mean ECD silver bromide tabular grain emulsion could be sensitized to a speed-granularity position superior to that of a silver iodobromide tabular grain emulsion of an essentially similar mean grain size.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains (a) having {111} major faces, (b) substantially free of iodide and containing at least 80 mole percent bromide, based on silver, (c) accounting for greater than 90 percent of total grain projected area, and (d) having latent image forming chemical sensitization sites on the surfaces of the tabular grains, and (3) a spectral sensitizing dye adsorbed to the surfaces of the tabular grains, wherein (4) the surface chemical sensitization sites include epitaxially deposited silver halide protrusions of a face centered cubic rock salt crystal lattice structure forming epitaxial junctions with the tabular grains, the protrusions (a) being restricted to those portions of the tabular grains located nearest peripheral edges of and accounting for less than 50 percent of the {111} major faces of the tabular grains and (b) containing silver iodide and a silver chloride concentration at least 10 mole percent higher than that of the tabular grains, (5) the tabular grains exhibit an average aspect ratio of greater than 50 and an average equivalent circular diameter of greater than 10 micrometers.

2. A radiation-sensitive emulsion according to claim 1 wherein said tabular grains contain up to 10 mole percent chloride.

3. A radiation-sensitive emulsion according to claim 2 wherein said tabular grains contain up to 5 mole percent chloride.

4. A radiation-sensitive emulsion according to claim 1 wherein said protrusions contain from 1 to 15 mole percent iodide.

5. A radiation-sensitive emulsion according to claim 4 wherein said protrusions contain from 2 to 10 mole percent iodide.

6. A radiation-sensitive emulsion according to claim 1 wherein said protrusions contain at least 15 mole percent higher chloride ion concentrations than said tabular grains.

7. A radiation-sensitive emulsion according to claim 6 wherein said protrusions contain at least 20 mole percent higher chloride ion concentrations than said tabular grains.

8. A radiation-sensitive emulsion according to claim 1 wherein said protrusions account for from 0.3 to 25 percent of total silver.

9. A radiation-sensitive emulsion according to claim 1 where the epitaxially deposited silver halide protrusions are located on less than 25 percent of the tabular grain surfaces.

10. A radiation-sensitive emulsion according to claim 9 wherein the epitaxially deposited silver halide protrusions are predominantly located adjacent at least one of the edges and corners of the tabular grains.

11. A radiation-sensitive emulsion according to claim 1 wherein the tabular grains have mean equivalent circular diameter of up to 15 μm.

12. A radiation-sensitive emulsion according to claim 1 wherein the tabular grains account for greater than 97 percent of total grain projected area.

13. A radiation-sensitive emulsion according to claim 1 wherein the spectral sensitizing dye exhibits an absorption peak at wavelengths longer than 430 nm.

14. A radiation-sensitive emulsion according to claim 13 wherein the spectral sensitizing dye is a J-aggregated cyanine dye.

* * * * *